US005460859A

United States Patent [19]

Reale

[11] Patent Number: 5,460,859

[45] Date of Patent: Oct. 24, 1995

[54] METHOD AND SYSTEM FOR DIP COATING AN ARTICLE HAVING LARGE OPEN AREAS OR A MULTIPLICITY OF APERTURES

[75] Inventor: Louis Reale, Rochester, N.Y.

[73] Assignee: Xerox Corporation, Stamford, Conn.

[21] Appl. No.: 855,830

[22] Filed: Mar. 23, 1992

[51] Int. Cl.[6] ..... B05D 3/12

[52] U.S. Cl. ..... 427/560; 118/57; 118/428; 427/235; 427/264; 427/271; 427/346; 427/430.1; 427/601

[58] Field of Search ..... 427/57, 560, 601, 427/235, 264, 271, 346, 430.1; 118/57, 428

[56] References Cited

U.S. PATENT DOCUMENTS

| | | | |
|---|---|---|---|
| 3,194,681 | 7/1965 | Nicholson et al. | 117/212 |
| 3,884,727 | 5/1975 | Jacobs | 148/6.2 |
| 4,210,095 | 7/1980 | Rouquie | 118/57 |
| 4,353,934 | 10/1982 | Nakashima et al. | 427/57 |
| 4,418,641 | 12/1983 | Nakashima et al. | 118/429 |
| 4,501,768 | 2/1985 | Kumar | 427/57 |
| 4,836,858 | 6/1989 | Reinhart | 134/1 |
| 4,858,264 | 8/1989 | Reinhart | 15/93 R |
| 4,974,616 | 12/1990 | Lee | 134/1 |
| 5,045,353 | 9/1991 | Takada et al. | 427/243 |

OTHER PUBLICATIONS

"Ultrasonics (High Power)" and Ultrasonics (Low Power), *Kirk—Othmer Encyclopedia of Chemical Technology,* vol. 23, Third Edition, John Wiley & Sons, New York (1983), pp. 462–490 (no month avail.).

*Primary Examiner*—Bernard Pianalto
*Attorney, Agent, or Firm*—Denis A. Robitaille

[57] ABSTRACT

A method and system is disclosed in which an article, having large open areas or a multiplicity of apertures, is dip coated. The method and system is particularly adapted for use in coating a grid of a corona charging device utilized in the xerographic process. A transport system immerses and removes the article from a tank storing coating material. An unwanted coating material is created across the apertures of the article. Thereafter, the transport system moves the article past an ultrasonic wave source. The impact of the ultrasonic energy transmitted to the unwanted coating material across the apertures causes the removal thereof. The removed coating material is returned to the coating material in which the article was immersed.

20 Claims, 4 Drawing Sheets

METHOD AND SYSTEM FOR DIP COATING AN ARTICLE HAVING LARGE OPEN AREAS OR A MULTIPLICITY OF APERTURES

This invention relates generally to dip coating an article or part having large open areas or a multiplicity of apertures, and more specifically, the present invention is directed to an improved method for dip coating a perforated grid adapted for use with a corona charging device in an electrophotographic printing machine.

A variety of coating processes are well known in the art. The known coating processes work well in coating articles having large solid areas. There are certain difficulties, such as nonuniform coating when coating articles with large open areas or a multiplicity of apertures. In spray coating, transfer efficiency is very poor with large open area articles. An excessive amount of the coating material passes through the open areas of the article never contacting the solid surfaces desired to be coated. The excess material is usually exhausted to the outside atmosphere. This waste not only decreases transfer efficiency and increases the price of the article, but also adversely affects the quality of the environment. In spray coating, there is also incomplete coverage of the interior wall surfaces or rims forming the open areas or apertures thereof. The problem frequently arises because of inadequate or improper angling of the spray gun. In rolling coating, there is also incomplete coverage of an interior wall surface of the article because the roller is too large to fit within the open area defined by the interior wall surface, and as a result, coating is never applied to the interior wall surface. In electrostatic spraying, there is poor coverage on the interior wall surface due to the Faraday Cage Effect—the electromagnetic field attracting the coatings to the article does not influence an attraction of the coating material to the interior wall surface. In dip coating, there is excellent transfer efficiency, but there is a problem of removing unwanted beads or film of coating material from the apertures in the article.

An example of an article, having large open areas or a multiplicity of apertures, is the grid of a corona charging device used in the charging process of an electrophotographic system. The grid is placed over a corona charging device, which in one form has a longitudinally extending housing member, often having a bracket or semicircular cross-sectional shape, housing an electrically conducting wire in the center thereof. In another form of the corona charging device, a longitudinally extending conductive member, having a plurality of spaced apart pin members extending therefrom, is disposed within the housing member. A variety of corona charging devices and shapes thereof exist. The corona charging device is used to regulate the voltage on a photoconductive member in an electrophotographic system. In the corona charging device consisting of a longitudinally extending housing member member housing a current carrying wire, a first electric field is generated between the wire and the grounded housing member and a second electric field is generated between the wire and the grounded photoconductive member. The grounded housing member helps control the strength of the second field between the wire and the photoconductive member, and the shape of the housing member helps control the direction of the second field. The grid, placed between the wire and the photoconductive member, limits further charging of the photoconductive member beyond a desired level. The grid is connected to a power supply, preferably through a varistor. As the strength of the second field between the photoconductive member and the wire increases, the voltage to the grid is modified by the varistor to attract electrons in the second electric field to the grid until no further charging of the photoconductive member occurs. The open area of a corona charging device grid is typically 65 to 75 percent. The forming of beads over the open areas of the corona grid would prevent the corona charging device from performing its intended function of charging. The electrons within the field between the wire and the photoconductive member would not be able to pass through the aperture in the grid onto the photoconductive member to charge the surface thereof to a desire voltage. Thus, a coating technique which forms beads within the apertures of the grid renders an unacceptable article.

There exists a need for a quick and transfer efficient coating process which uniformly coats an article, such as a corona grid, and which removes the unwanted coating beads from the apertures of the article.

The following disclosures may be relevant to various aspects of the present invention:

U.S. Pat. No. 3,194,681 Patentee Nicholson et al. Issued: Jul. 13, 1965

U.S. Pat. No. 3,884,727 Patentee: Jacobs Issued: May 20, 1975

U.S. Pat. No. 4,353,934 Patentee: Nakashima et al. Issued: Oct. 12, 1982

U.S. Pat. No. 4,418,641 Patentee: Nakashima et al. Issued: Dec. 6, 1983

U.S. Pat. No. 4,501,768 Patentee: Kumar Issued: Feb. 26, 1985

U.S. Pat. No. 4,836,858 Patentee: Reinhart Issued: Jun. 6, 1989

U.S. Pat. No. 4,858,264 Patentee: Reinhart Issued: Aug. 22, 1989

U.S. Pat. No. 4,974,616 Patentee: Lee Issued: Dec. 4, 1990

U.S. Pat. No. 5,045,353 Patentee: Takada et al. Issued: Sep. 3, 1991

The relevant portions of the foregoing disclosures may be briefly summarized as follows:

U.S. Pat. No. 4,418,641 and U.S. Pat. No. 4,353,934, each disclose a dip-coating method and apparatus for forming a coated film on the surface of an article by dipping the article in a coating solution. An ultrasonic wave oscillator, positioned outside a coating tank, has an oscillating surface arranged opposed to the bottom surface of the coating solution tank but which may be directed upward into the coating tank. Ultrasonic waves are generated to act on the coating solution to form a uniform liquid flow on the surface of the coating solution. The uniform surface liquid flows toward an overflow pocket on the surface of the coating solution tank. Cavitation bubbles, produced by the ultrasonic waves, smoothly flow away from the coating solution tank while making the cavitation bubbles act on the article to be coated.

U.S. Pat. No. 3,194,681 discloses a process for plating through holes in a dielectric material. A more complete penetration of the sensitizing solution into the small pores and interstices present upon the panel surfaces is effectuated. The sensitizing bath is agitated ultrasonically at a frequency selected from the range of 20 to 400 kilocycles. The ultrasonic application insures a more intimate contact of the sensitizing solution with the interior surface areas thereof, and frequently replenishes the solution presented to the surface areas.

U.S. Pat. No. 4,501,768 discloses a method of coating or cladding existing metallurgical features of a dielectric substrate with discrete levels of diverse metals forming alloys.

The mechanism of metal film removal is by ultrasonic cleaning which involves rupturing loose metal film from the substrate areas by action of shock waves impinging on the surface. The metal film is removed by the use of an ultrasonic horn, mounted to the cleaning tank, adapted to focus and deliver very high localized intensities of energy.

U.S. Pat. No. 4,974,616 discloses a method of removing a coating from a cathode ray tube comprising immersing the tube in a bath of alkaline liquid and subjecting the bath to ultrasonic excitation.

U.S. Pat. No. 5,045,353 discloses a method for treating the interior surfaces of holes as well as the surfaces of an article by dipping it into treating liquid. Alternating air bubble supplying jets are positioned along both ends of a plurality of holes within an article. The alternating air bubble supplying jets provide liquid flows at both end of the holes at different velocities in a direction perpendicular to the hole. The difference in the flow velocities causes the pressure at both ends of the hole to be different. As a result the liquid flows within the hole from one end of a high pressure to the other end of a lower pressure.

U.S. Pat. No. 4,836,858 and 4,858,264 each disclose the utilization of an ultrasonic transducer to remove paint coatings from a surface. The ultrasonic transducer has a square or blunt edge energized in a reciprocal or vibratory axial motion to engage in destructive contact with the coating on a surface.

U.S. Pat. No. 3,884,727 discloses a method for coating a wire screen cloth by immersing the wire cloth in an abrasive and corrosive resistant material. Also disclosed is testing of the wire screen cloth on an electrically vibrating screening machine.

In accordance with one aspect of the present invention, there is provided a method for coating an article having apertures therein with a coating material and removing the coating material disposed within the apertures formed by the coating of the article. The method comprises the steps of: immersing the article in coating material stored in a housing to substantially coat the article; removing the article from the coating material; and applying ultrasonic waves to the article to substantially remove the coating material from the apertures therein.

Pursuant to another aspect of the present invention, there is provided a system for coating an article having apertures therein with a coating material and removing the coating material disposed within the apertures formed by the coating of the article. The system comprises means for storing a supply of the coating material; means for immersing the article in the coating material and removing the article therefrom to substantially coat the article; and means for applying ultrasonic waves to the article to substantially remove the coating material from the apertures therein.

Other features of the present invention will become apparent as the description thereof proceeds and upon reference to the accompanying drawings, in which:

Figure 1:
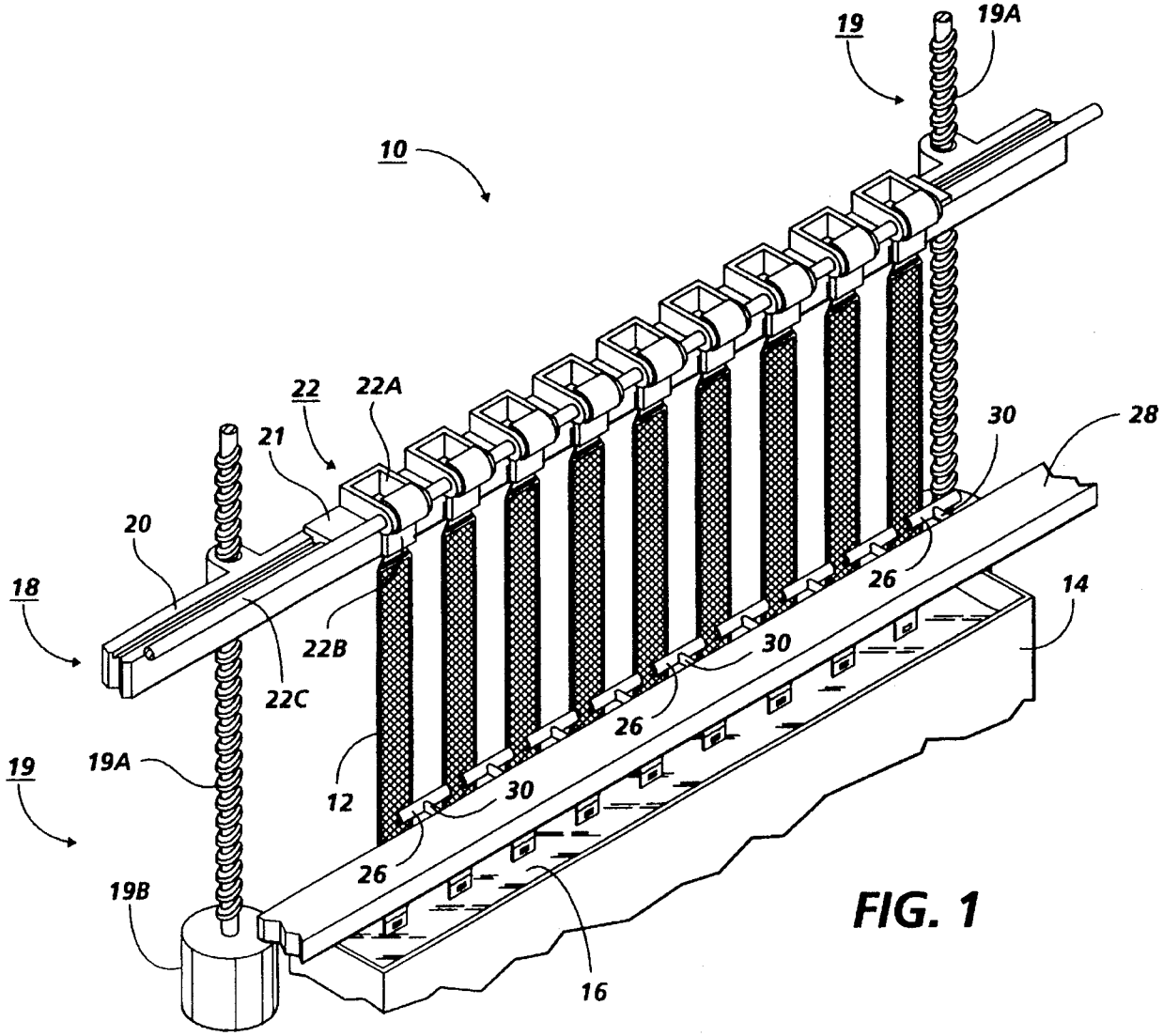
FIG. 1 is a perspective view of a system for coating an article in accordance with one embodiment of the coating system of the present invention incorporating a proposed design of an ultrasonic transducer.

In the drawings and the following description, it is to be understood that like numeric designations refer to components of like function.

Turning to FIG. 1, there is illustrated a coating system 10 for coating a workpiece or article 12 having substantial open areas or multiplicity of apertures. One example of such an article 12 is the grid of a corona charging device utilized in the xerographic process. U.S. Pat. Nos. 4,646,196 and 4,920,266, each to Reale, illustrate such charging devices and the perforated grids which are adapted to be positioned against the open side of such charging devices. The relevant portions, specifically including the FIGS. 4 and 5 and the description thereof, in both U.S. Pat. Nos. 4,646,196 and 4,920,266 are incorporated herein by reference thereto.

The coating system 10 includes a tank 14 for storing a bath of coating material 16 therein. A transport system 18 moves the article 12 above the coating material 16 in the tank 14. The transport system 18 then immerses the article 12 in the coating material stored in the tank 14 and removes the article 12 therefrom. The immersion and removal of the article substantially coats the article 12. The transport system 18 preferably includes an elevator 19 for vertical travel. The illustrative elevator 19 has rotatably driven vertical threaded shafts 19A driven by motors 19B. The transport system 18 includes a horizontally extending support frame 20 having a grooved aperture for receiving the threaded shafts 19A of the elevator 19. Rotation of the threaded shafts moves the support frame 20 vertically. The support frame 20 has a movable carriage 21 which may be actuated to move horizontally by a suitable device such as motor driven belts or cams. A plurality of gripping mechanism 22, adapted to grip the articles 12, have their fixed bases 22A extending upward from the carriage 21. Each gripping mechanism 22 has a movable portion 22B mounted for rotation with a shaft 22C. The shaft 22C can be rotated so that the movable portion 2213 of the gripping mechanism 22 pinches the article 12 against the support frame 21. Several individual articles 12 may be lowered or dipped simultaneously into the tank 14 through the utilization of the elevator 19. Simultaneous dipping is particularly desirable when the articles 12 are connected in a sheet like form.

A variety of alternative securing or gripping mechanisms may be utilized. A plurality of pins could extend from the carriage 21 and be inserted within a single large aperture at an upper end of the article 12 to secure the article 12. A plurality of gripping mechanisms could be individually movable in the vertical direction by suitable devices, such as a piston and cylinder combination, to individually lower or dip the articles 12 into the coating material 16.

If desired, a weighted mechanism can be attached to the article 12 at the lower end thereof to prevent movement (swaying) of the article. Such a weighted mechanism is particularly desirable with large thin articles. Another movement (swaying) prevention mechanism which could be employed is a rack, in a general picture frame shape, having crossbars attached to the bottom and the top of the article 12.

Once lowered into the tank 14, the article 12 is suitably coated with a desired material according to its intended function. With respect to the article 12 in the form of a grid of a corona charging device, any suitable coating material, including a binder in combination with a conductor, will suffice which will not break down under an applied corona voltage, and which will withstand chemical attack under the conditions present in a corona generating device. Examples of such coating materials, particularly adapted for coating a corona charging device grid are described in U.S. Pat. Nos. 4,585,322 and 4,646,196 and 4,920,266, each of which is issued to Reale and assigned to Xerox™ Corporation, the relevant portions, specifically including the description of the coating materials described therein, are incorporated herein by reference thereto. For example, a coating material may include binders, such as aluminum hydroxide or silicate compounds (potassium, lithium and sodium silicates, etc.), combined with electrically conductive fillers, such as graphite or a mixture of nickel and graphite.

The coating process, such as utilized by the coating system 10, is often referred to as dip coating since the articles 12 are "dipped" into the coating material. The dip coating process is advantageous in that the article 12 can be effectively coated. The entire exposed surfaces of the article 12, including the hard to reach interior wall surfaces or rims forming the apertures, can have the coating material applied thereto. A desired coating is thus, applied to the exposed surfaces. However, when an article 12 is dip coated, a film or beads of unwanted coating material 23, invariably covers the apertures of the article 12. The beads 23, if left remaining in the apertures, will render the article 12 unacceptable as well as waste substantial quantities of coating material 16. To counteract these difficulties, the coating system 10 of the present invention utilizes one or more ultrasonic transducers to remove the beads 23 within the apertures of the article 12.

As the article 12 is raised from the tank 14, an ultrasonic wave source applies ultrasonic waves through a gaseous medium, such as normal atmospheric air, to the article 12. The ultrasonic wave source may be in the form of an ultrasonic transducer assembly 24 comprising one or more ultrasonic transducers 26 emitting ultrasonic sound waves against the article 12. The transducers 26 are integrally connected to the assembly body 28 by a shaft 30. Each transducer 26 can generate the motion amplitude or vibrating motion thereof in a variety of ways. In one example, the transducer 26 has a pair of conductors mounted to the back wall thereof providing electrical connection to a suitable AC source. One of the conductors is connected to the outer shell for grounding. The other connector is attached to a wire, inside the shell, connected to a piezoelectric element. The piezoelectric element is mounted to the interior side of the front wall. When an electric current or electric field is applied to a piezoelectric element, the piezoelectric element expands or contracts. If the piezoelectric element is subjected to a rapidly alternating electric field of a suitable AC source, the piezoelectric element and the front wall, to which the element is mounted to, respond with a vigorous resonant vibration and the irradiation of an ultrasonic wave front from the exterior surface of the front wall. Each piezoelectric transducer design (size, shape, weight, flexibility, etc.) possesses a certain optimal resonant operating frequency to facilitate the generation of a desired ultrasonic or acoustic energy density level. The generation of the desired ultrasonic energy level can then be utilized according to the present invention to remove the coating material 23 from the apertures of the article 12.

As the ultrasonic waves impact against the article 12 and the beads 23 within the apertures of the article 12, the beads 23 are disrupted and dispersed from the apertures. While bead rupture is not fully understood, it is believed that the absorption of energy by the coating beads 23 causes the violent enlargement and collapse of preexisting or created bubbles. The violent enlargement and collapse causes a near instantaneous release of mechanical energy. There is a sudden drop in surface tension of trapped beads 23. causing the surface tension between the beads 23 and the rims of the article forming the apertures. Eventually, The drop in surface tension assists the trapped beads 23 to be unseated from their position within the apertures of article 12. It is believed that a form of cavitation is partially or totally responsible for the bead rupture. The ultrasonic transducer thus applies ultrasonic waves through in a gaseous medium to the article to substantially remove the coating material from the apertures therein.

In cavitation, transient minute cavities are formed in the liquid, such as the coating beads 23, by a stress, such as an applied ultrasonic wave field. The transient cavities formed by the stress are unstable and would grow indefinitely if the stress were maintained. After the minute cavities or cavitation nuclei have been expanded to many times their original size, they collapse violently if the stress is reduced or removed. The kinetic energy of the liquid that follows the collapsing interface becomes highly concentrated as the cavities collapses. If the transient cavities contain very little permanent gas, the peak pressures at collapse may reach thousands of bars, the temperature may reach thousands of degrees, and strong shock waves may be radiated to a distance of several cavity radii. In another form of this phenomena, pseudo cavitation, in nondegassed liquids, the cavities are filled with gases dissolved in the liquid and produced whenever the instantaneous pressure falls below the vapor pressure. This effect is distinguished from cavitation, occurring in pure degassed liquids, where an actual rupture of the liquid occurs at much higher sound pressures. The desirable coating film, which is deposited onto the exposed surfaces of the article 12, remains thereon because the bond caused by the adhering surface of the coating material onto the exterior surface of article 12 is sufficient to withstand the stress induced by the ultrasonic wave front. In contrast, the coating beads 23 attached only to the interior wall surfaces or rims forming the apertures, have weak surface adhering contact insufficient to withstand the effects of the stress induced by the ultrasonic wave front.

The cavitation of the beads 23 from the apertures causes a downward flow of the coating material 23 along the article 12 until eventually the beads 23 are deposited into the tank 14 of coating material 16 by falling therein. The coating material 23 which is deposited or falls into the tank 14 is available for subsequent use, thus increasing the transfer efficiency of the coating system and providing substantial economic savings. The removal from the article 12 of the beads 23 enables the article 12 to perform its intended function which would otherwise be affected if the apertures thereof were covered with coating beads 23.

Since the transducer 26 is spaced apart from the article 12 and functions in a gaseous medium, such as air, and the ultrasonic waves travel through a gaseous medium, such as air, the transducer 26 should be in very close proximity to the article 12 to prevent the dissipation of the energy density of the ultrasonic wave before impacting the article 12.

Preferably, the ultrasonic transducer 26 is horizontally spaced from the article 12 at a distance ranging from 1/16 to ½ inches. Desirably, the transducer 26 is positioned slightly above the coating material 16, preferably as close to the fluid surface of the coating material 16 as possible. The transducer 26, thus emits an ultrasonic wave front at an elevation generally adjacently above the elevation of the coating material 16. This position of the transducer 26 facilitates the application of ultrasonic waves immediately subsequent to the coating. Immediate subsequent application of the ultrasonic waves limits the in air time of the coating beads 23, thereby limiting the evaporation of the coating beads 23. Therefore, the transfer efficiency is increased and the cost of the coating process is decreased. In addition, limiting evaporation of the removed coating beads 23 assures that the quality of coating beads 23, removed from the apertures and returned to the tank 14, is of substantially the same composition of the coating material 16 which remains in the tank 14.

Figure 2:
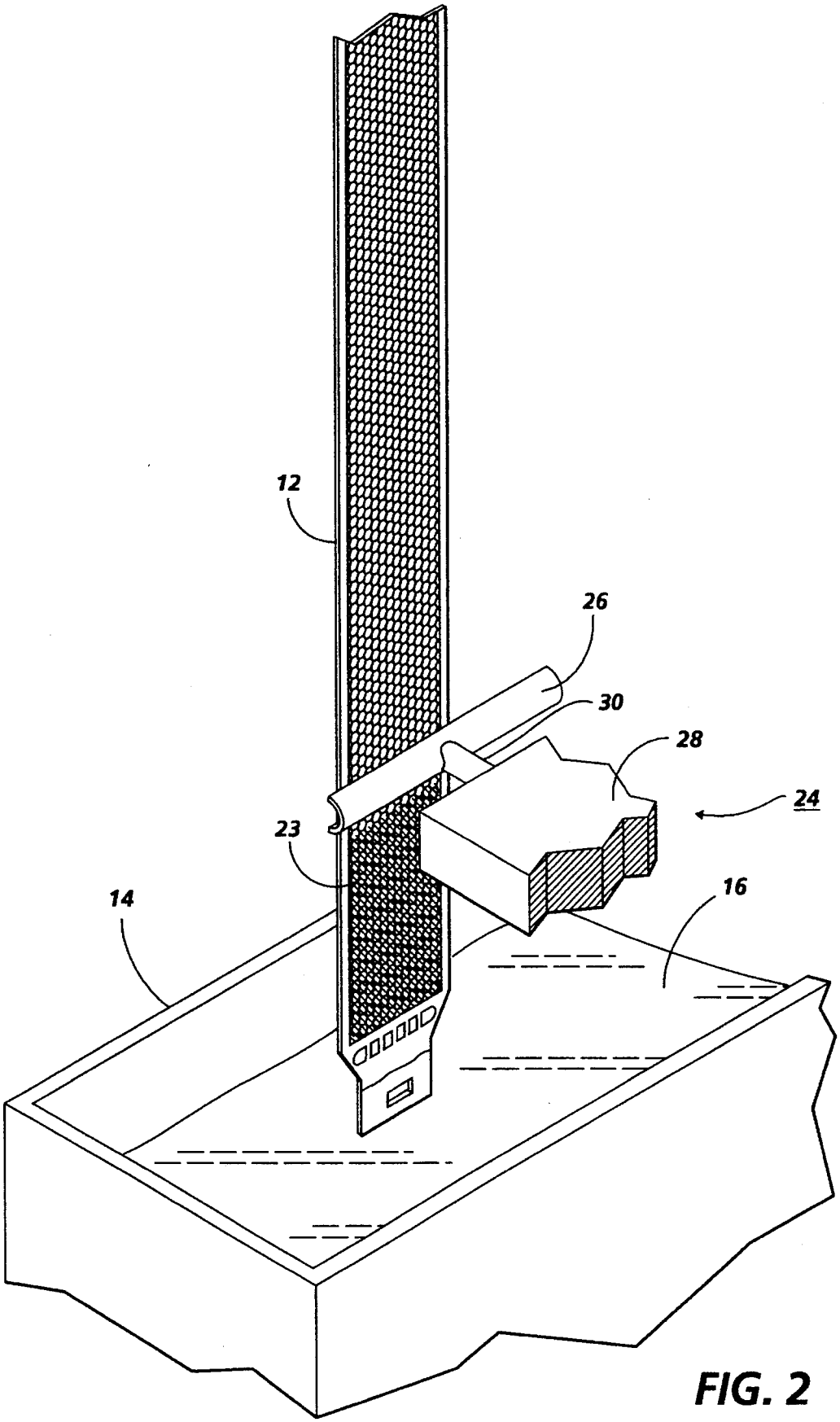
FIG. 2 is an enlarged perspective view of the proposed ultrasonic transducer of the coating system of the present invention and the article.

Referring to FIGS. 2, there is illustrated in greater detail, one embodiment of the transducer assembly 24. The ultrasonic transducer 26 has a width generally greater than the width of the article 12. In general, as an ultrasonic wave travels, the ultrasonic energy density carried thereby decreases. By positioning the ultrasonic transducer 26, having a substantial width, in close proximity to the article 12, the portion of the ultrasonic wave front, possessing a sufficient ultrasonic energy density to remove the beads 23 from the article 12 can impact the entire width of the article 12. This assures that the coating beads 23 and article 12 are impacted with uniform ultrasonic energy along the entire width of the article. Otherwise, as in circular transducer 26 having a width equal or less than the width of the article, the center of the article would be impacted with ultrasonic energy density higher than at the edges. Thus, in the present system, one portion, such as the center, of the article 12 is not impacted with a high ultrasonic energy density level while other portions, such as the edges of the article 12, are impacted with a lower ultrasonic energy density level possibly insufficient to remove the coating beads 23 free from the apertures within that portion.

The proposed design of the transducer 26 has a concave wave emitting surface, having a generally C-shaped cross section, which is particularly adapted for focusing the sound waves along a common axis or axes to a single elevation on the article 12 along the width thereof. Generally, in an ultrasonic wave field, ultrasonic waves originate from a transducer and move radially outward therefrom increasing in size but decreasing in ultrasonic energy density. The concave emitting surface of the transducer 26 attempts to counteract this radial expansion of the wave and resulting decrease in ultrasonic energy. The C-shaped surface of the transducer 26 directs or focuses the waves or wave portions so that the preponderance of their radially movement is generally along common axes as adjoining waves or portions thereof. These common axes are perpendicular to the concave emitting surface originating from points in or generally adjacent to the center thereof. The waves still dissipate ultrasonic energy as they travel but since they are being integrated or combined at their common axes, the level of energy at these common axes has an integrated high energy level. The integrated high energy level is a sum of the energy level of the waves or wave portions which are integrated or combined at their common axes. The size and curvature of the transducer 26 is so designed so that the focal point of the curvature, the distance at which the ultrasonic waves are at the maximum intensity or energy level corresponds to the distance at which the transducer 26 is positioned from the article 12.

The illustrative ultrasonic transducers 26 of FIGS. 1 and 2 are a proposed design of an ultrasonic transducer employing a concave trough for emitting ultrasonic waves therefrom. It is not altogether certain that an effective ultrasonic transducer employing a concave trough can be manufactured. It is believed that such a transducer would be a preferred embodiment due to energy efficiency. This is because the ultrasonic waves emitted therefrom would be focused by the concave shape of the trough.

Figure 3:
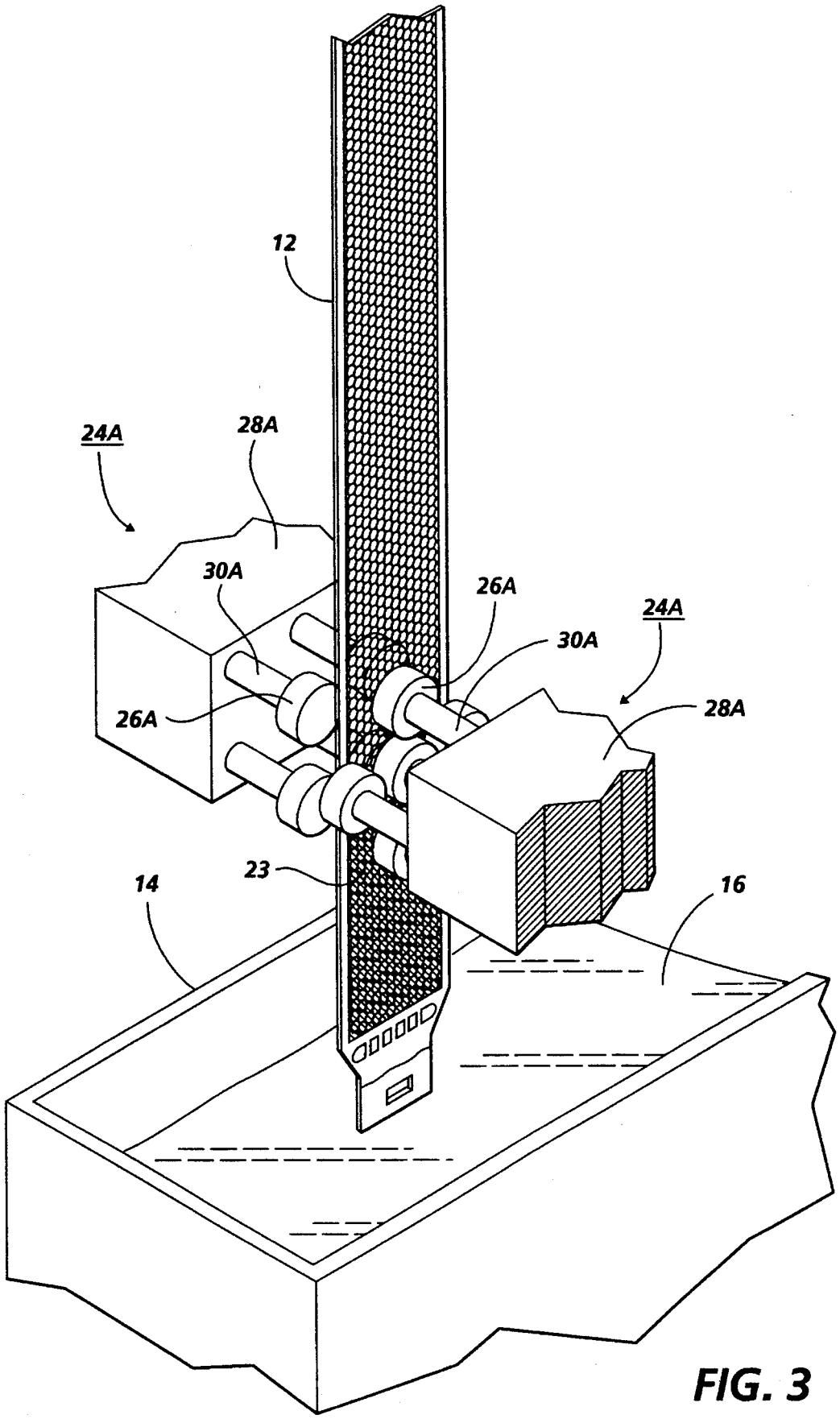
FIG. 3 is a perspective view of two sets of a plurality of ultrasonic transducers in another embodiment of the coating system of the present invention and the article.

Referring to FIG. 3, there is illustrated in greater detail, another embodiment of the transducer assembly designated by the reference numeral 24A. The ultrasonic transducer assembly 24A has two sets of a plurality of ultrasonic wave transducers designated by the reference numerals 26A. Each set is positioned on opposite sides of the article 12 and arranged in opposite patterns so the entire article is impacted with ultrasonic waves. The first set of transducers 26 has a pattern of four transducer divided into two rows of two transducers 26 (a :: pattern). The second set of transducers 26 has a pattern of five transducers divided into three rows. The middle row has three transducers 26 and the top and bottom rows have one transducer above and below, respectively, the middle transducer of the middle row (a plus sign pattern). The pattern of the two sets of transducers 26 is but one example of opposite matching patterns assuring application of ultrasonic waves to the entire width of the article 12. As a group, the transducers 26A extend a distance spanning generally equal to or greater than the width of the article 12. Each of the transducers 26A is connected to the body 26A of the transducer assembly 24A by the shafts 30A. An ultrasonic wave front of sufficient ultrasonic energy density to remove the beads 23 will impact against various portions along the entire width of the article 12 so that each aperture of the article 12 has the beads removed therefrom. The removal of the unwanted coating beads 23 from the article is again achieved through cavitation of the beads 23 within the apertures the article 12 initiating the deposit of the beads 23 into the tank 14.

The transducers 26A have a generally circular cross-section, and the emitting surface thereof is generally planar as opposed to the concave emitting surface of the transducer 26. One example of a transducer 26A, adapted for use in air, is model TR-89/B Series, Types: 23, 31, 40 by Massa Products Corporation. Type 23 has proven to be the most effective of the three. Type 23 provides peak untuned receiving response at 23 kHz+ or −2 kHz, while Type 31 and Type 40, provide peak untuned receiving responses at 31 kHz+ or −2 kHz and 40 kHz+ or −2 kHz, respectively. Thus, the Type 23 transducer responds to an AC signal of resonant frequency of 21 to 25 kHz, preferably at 23 kHz. This frequency is the resonant frequency whereat the greatest mechanical motion is achieved. The energy density of the wave front emitted from the surface transducer 26A which reaches the article 12 is nonuniform. The transducer 26 is less efficient than that of the transducer 26 because there is no localizing effect of the waves. Thus, the focalizing effect assures that a more uniform front of sufficient ultrasonic energy density is applied to the article 12.

Figure 4:
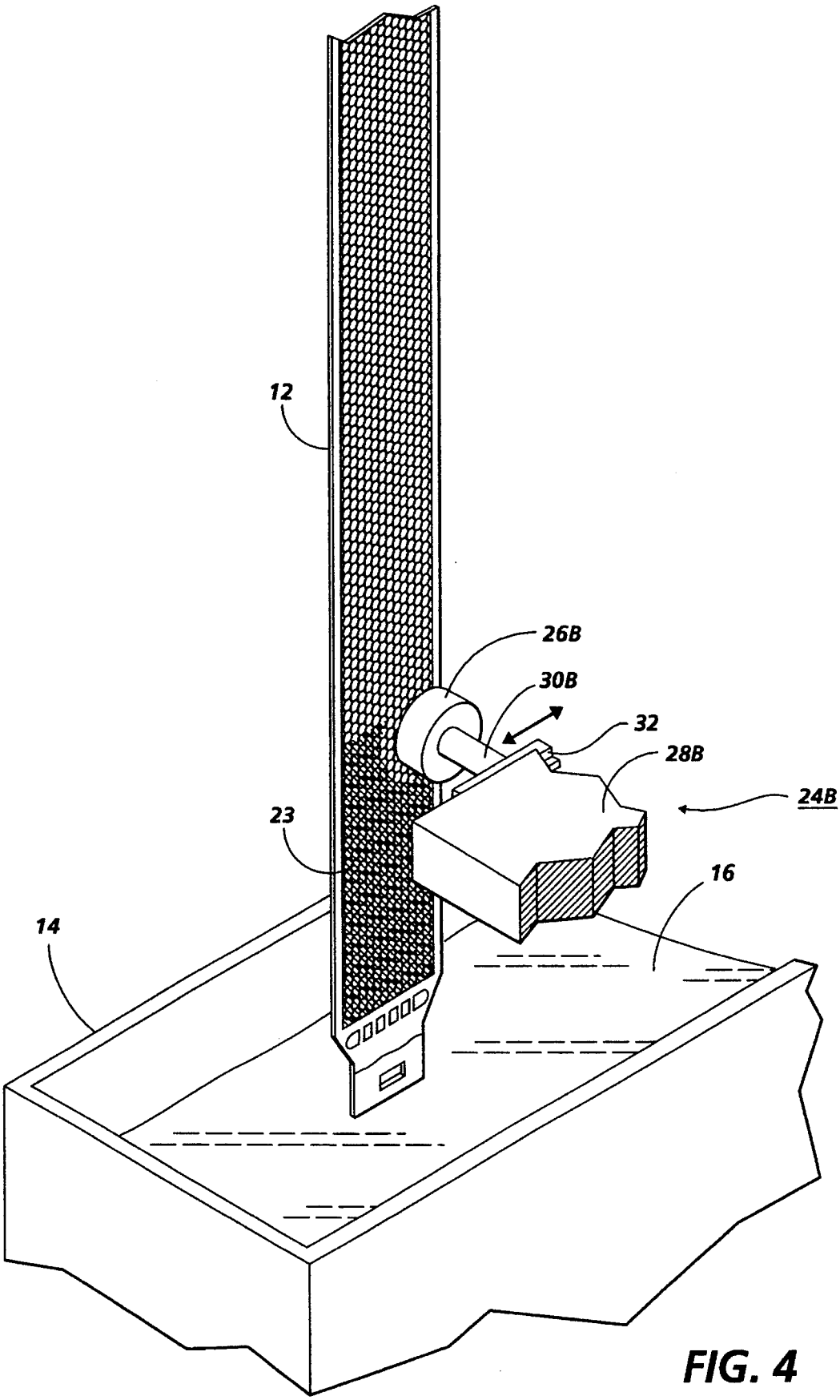
FIG. 4 is a perspective view of an ultrasonic transducer mounted to a reciprocating carriage in yet another embodiment of the coating system of the present invention, and the article.

Referring to FIG. 4, there is illustrated another arrangement of the transducer assembly designated by the reference numeral 24B comprising a single transducer 26B, circular in cross-section, having a planar emitting surface. The single transducer 26B is of insufficient width to span a distance greater than the full width of the article 12. The transducer 26B is mounted on a shaft 30B which, in turn, is mounted on a movable carriage 32 within the body 28B. The carriage 32 is disposed within guide rails extending in a direction parallel to the width of the article, i.e., horizontally. The transducer 26B is integrally connected to the carriage 32 for movement therewith, relative to the article 12, over a distance greater than the area or width of the article 12. To compensate for the difficulty of nonuniform application of the ultrasonic waves, the carriage 32 is horizontally driven by a suitable device such as a motor so that the transducers 26B can slide horizontally to apply ultrasonic waves across the entire area or width of the article 12. To achieve uniform ultrasonic application, it is necessary that the elevating or lifting of the transport system 18 be adjusted so that the transducer 26B can slide across the full width of the article 12 at substantially a single elevation during each horizontal movement. To achieve this effect, the article 12 could be raised and stopped at discrete elevations, or the horizontal movement of the transducer 26B, effected by the movable motor-driven carriage 32, could be produced at a vastly higher speed relative to the vertical speed of the article 12.

In each of the figures, the size and number of the articles 12, aperture geometry, and the components of the coating system 10 are shown only for illustrative example. For instance, the width of an article 12 in the form of a grid for a corona charging device typically can be within three quarters of an inch to three inches. The diameter of an individual transducers 26A and 26B, circular in cross-section, may be an inch in diameter. If the grid has a width of three-quarters of an inch, use of more than one transducer in such a situation may not be of any additional benefit. Thus, it should be understood that the use of a single transducer could be effectively employed in situations where the width of the article 12 is substantially smaller than the width of the transducer. The difficulty in general with using only a single transducer is that the size and shape of a single transducer may not always adequately cause the entire article to be impacted with an ultrasonic wave or with ultrasonic wave front of uniform high energy density levels. Such difficulties can cause some of the coating beads to remain in the apertures of the article 12. Therefore, providing movement of the transducers 26 across the width of the article 12, as in the embodiment of FIG. 4, is considered particularly desirable in facilitating the uniform application of ultrasonic waves using only a single transducer.

The directions of movement of the article 12 in the vertical direction and the transducers 26B in the horizontal direction are shown only as illustrative example. It should be understood the article 12 can be removed from the coating material in a first direction, which can be any direction besides vertical, such as horizontal. As the article 12 is removed, the article can be continued to move in the first direction past an ultrasonic wave source. Likewise, the article 12 can be moved past the ultrasonic wave source in a second direction, which can be any direction besides horizontal, such as vertical. The second direction is transverse to the first direction, preferably perpendicular thereto.

In recapitulation, it is evident that the coating method and system of the present invention immerses or dips an article in a coating material to provide a quick coating method which applies coating to the entire surface of the article including the hard to reach interior wall surfaces or rims forming the apertures. Concurrent with the desirable coating application to the article, beads or film of unwanted coating material is invariably formed on the article across the apertures thereof. The article is removed from the coating material and moved past an ultrasonic wave source. The ultrasonic wave source emits an ultrasonic wave front which impacts against the article. The ultrasonic energy carried by the wave front creates cavitation causing the disruption and dispersion of the unwanted beads or film of coating material, thereby removing the beads of coating material from the apertures of the article. The unwanted beads flow downward along the article, until deposit into the coating material for reuse. The article is fully and adequately coated on its exposed surfaces in a quick and transfer efficient process. The removal of the unwanted beads of coating material from across the apertures of the article prevents the article from being unacceptable.

A coating method and system, fully satisfying the aims and advantages set forth, has been described in conjunction with a specific embodiment thereof, it is evident that many alternatives, modifications, and variations will be apparent to those skilled in the art that fall within the spirit and broad scope of the appended claims.

What is claimed is:

1. A method for coating an article having apertures therein with a coating material and removing the coating material disposed within the apertures formed by the coating of the article, comprising the steps of:

immersing the article in coating material stored in a housing to substantially coat the article;

removing the article form the coating material; and emitting ultrasonic waves in the direction of the article for impacting against the article and the coating material disposed within the apertures thereof to substantially remove the coating material from the apertures.

2. A method according to claim 1, further comprising the step of depositing the coating material removed from the apertures into the coating material in which the article is being immersed.

3. A method according to claim 1, wherein said emitting step is performed subsequent to said removing step.

4. A method according to claim 1, wherein said emitting step is performed above the housing so that the removed coating material falls into the coating material stored in the housing.

5. A method according to claim 1, wherein said emitting step comprises the step of moving the article in a first direction relative to an ultrasonic wave source.

6. A method according to claim 5, wherein said emitting step comprises the step of moving the ultrasonic wave source in a second direction, transverse to the first direction.

7. A method according to claim 1, wherein said emitting step applies ultrasonic waves through a gaseous medium.

8. A system for coating an article having apertures therein with a coating material and removing the coating material disposed within the apertures formed by the coating of the article, comprising:

means for storing a supply of the coating material;

means for immersing the article in the coating material and removing the article therefrom to substantially coat the article; and means for emitting ultrasonic waves in the direction of the article for impacting against the article and the coating material disposed within the apertures thereof to substantially remove the coating material from the apertures.

9. A system according to claim 8, wherein said emitting means applies ultrasonic waves to the article subsequent to said immersing means removing the article from said storing means.

10. A system according to claim 8, wherein said emitting means is positioned above said storing means so that the removed coating material falls into the supply of coating material of said storing means.

11. A system according to claim 8, wherein the coating material removed from the apertures in the article is deposited in said storing means.

12. A system according to claim 8, wherein said immersing means moves the article in a first direction relative said applying means.

13. A system according to claim 8, wherein said emitting means moves relative to the article in a second direction, transverse to the first direction.

14. A system according to claim 8, wherein said emitting means applies ultrasonic waves through a gaseous medium.

15. A system according to claim 8, wherein said emitting means comprises an ultrasonic transducer.

16. A system according to claim 15, wherein said ultrasonic transducer comprises a concave surface adapted to focus the ultrasonic wavēs along a common axis.

17. A system according to claim 15, wherein said emitting means comprises a movable carriage, said ultrasonic transducer mounted thereon for movement therewith relative to the article.

18. A system according to claim 8, wherein said emitting means comprises a plurality of ultrasonic transducers.

19. A system according to claim 18, wherein said plurality of ultrasonic transducers are arranged in two sets of ultrasonic transducers disposed on opposite sides of the article and arranged in opposite matching patterns to provide uniform application of ultrasonic energy density to the article.

20. A system according to claim 8, wherein said emitting means is spaced apart from the article.

* * * * *